US005988127A

United States Patent [19]

Hasegawa et al.

[11] Patent Number: 5,988,127

[45] **Date of Patent: *Nov. 23, 1999**

[54] VALVE LIFTER STRUCTURE

[75] Inventors: Tadao Hasegawa, Toyota; Kiyoshi Sugimoto, Okazaki; Yoshihito Moriya, Nagoya, all of Japan

[73] Assignee: Toyota Jidosha Kabushiki Kaisha, Toyota, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/001,222

[22] Filed: Dec. 30, 1997

[30] Foreign Application Priority Data

Jan. 14, 1997 [JP] Japan ..... 9-004831

[51] Int. Cl.[6] ..... F01L 13/00

[52] U.S. Cl. ..... 123/90.18; 123/90.5

[58] Field of Search ..... 123/90.15, 90.17, 123/90.18, 90.48, 90.5

[56] References Cited

U.S. PATENT DOCUMENTS 5,159,906 11/1992 Fontichiaro et al. ..... 123/90.18

FOREIGN PATENT DOCUMENTS 0 108 238 5/1984 European Pat. Off. .

0 208 663 1/1987 European Pat. Off. .

3-179116 8/1991 Japan .

7-279631 10/1995 Japan .

*Primary Examiner*—Weilun Lo

*Attorney, Agent, or Firm*—Oliff & Berridge, PLC

[57] ABSTRACT

A valve lifter structure having a follower which tilts in a guide groove, for a mechanism for varying valve characteristics of a poppet valve by axial displacement of a three-dimensional cam having a profile varying in the axial direction, which is easily machined without degrading a mechanical strength. A guide groove is formed on a top surface of a valve lifter interposed between a cam and a top of a valve stem of a poppet valve to extend perpendicular to the axis of the cam. A follower is located in the guide groove, which extends in parallel to the guide groove and is capable of tilting in accordance with the change of the cam profile while being brought into slide-contact with the guide groove, and is inhibited from displacing in the extending direction by a limiting means. The guide groove is formed to have opposite open ends. The limiting means is defined by a stopper located on the guide groove side and an abutment member located on the follower side to abut to the stopper. The abutment member is defined by a pair of walls of the follower spaced at a distance opposite to each other in the extending direction thereof.

3 Claims, 5 Drawing Sheets

VALVE LIFTER STRUCTURE

BACKGROUND OF THE INVENTION

1. Field of the Invention

The present invention relates to a valve lifter structure and, particularly to a valve lifter structure in a mechanism for varying valve characteristics, for example, timings of valve opening and valve closing, valve lift and others, using a three-dimensional cam, arranged between the three-dimensional cam and a top of a valve stem of a poppet valve.

2. Description of the Prior Art

In a known mechanism for varying valve characteristics, a three-dimensional cam having a profile varying in the axial direction is displaced in the axial direction for the purpose of changing a valve-opening/closing timing of an intake valve or an exhaust valve, formed by a poppet valve in an internal combustion engine, in accordance with operational conditions.

When such a three-dimensional cam is used, the durability of a slanted cam surface and a cam follower can be improved by providing a guide groove on a top surface of a valve lifter arranged between the three-dimensional cam and a top of the valve stem of the poppet valve so that cam and the valve lifter are brought into surface-contact with each other.

For example, Japanese Unexamined Patent Publication No. 3-179116 discloses a mechanism wherein a guide groove completely encircled by walls is formed on a top of a valve lifter and a tilting follower is arranged therein, or the guide groove has a raised portion at a center thereof. In this mechanism, a slide-contact surface between the guide groove and the follower is necessarily formed with a high degree of precision so that the follower can be smoothly tilted.

However, the former type having the guide groove completely encircled with walls has a drawback in that it is difficult to machine the slide-contact surface to a high degree of precision because the tools usable for such a purpose are limited.

On the other hand, the latter type having a raised portion has a drawback in that part of the follower is necessarily thin-walled to receive such a portion, which weakens the follower.

SUMMARY OF THE INVENTION

An object of the present invention is to provide a valve lifter structure for a mechanism for varying valve characteristics using a three-dimensional cam which is easily manufactured and has a sufficient strength.

According to the present invention, a valve lifter structure is provided, for a mechanism, for varying valve characteristics of a poppet valve by the axial displacement of a three-dimensional cam having a profile varying in the axial direction, comprising a guide groove formed on a top surface of a valve lifter interposed between the cam and a top of a valve stem of the poppet valve, while extending perpendicular to the axis of the cam, a follower extending in parallel to the guide groove and capable of tilting in accordance with the change of the cam profile while being brought into slide-contact with the guide groove, and means for limiting the displacement of the follower in the extending direction thereof, wherein the guide groove is formed to have opposite open ends as seen in the extending direction thereof, and the limiting means comprises a stopper located on the guide groove side and an abutment member located on the follower side to abut to the stopper; the abutment member being a pair of walls arranged opposite to each other at a space in the extending direction of the follower.

The present invention will be more fully understood from the description of preferred embodiments of the invention set forth below, together with the accompanying drawings.

DESCRIPTION OF THE PREFERRED EMBODIMENTS

Figure 1:
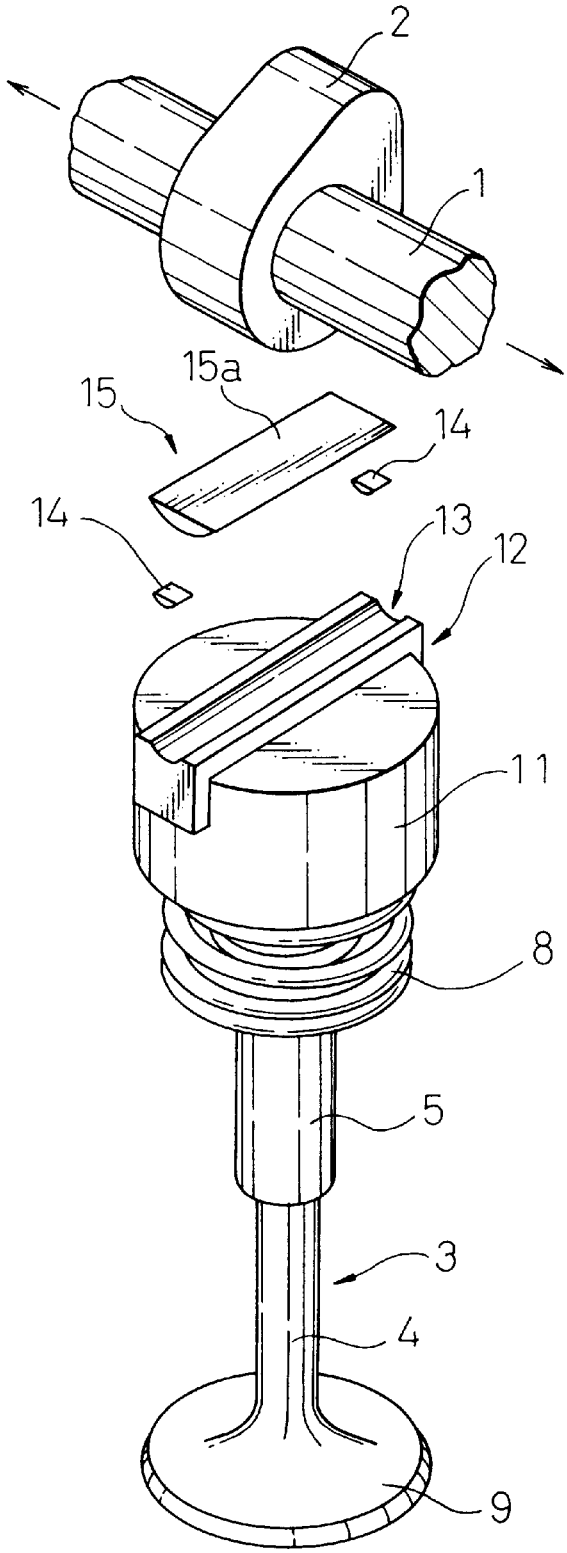
FIG. 1 is an exploded perspective view of a first embodiment of the present invention.
Figure 2:
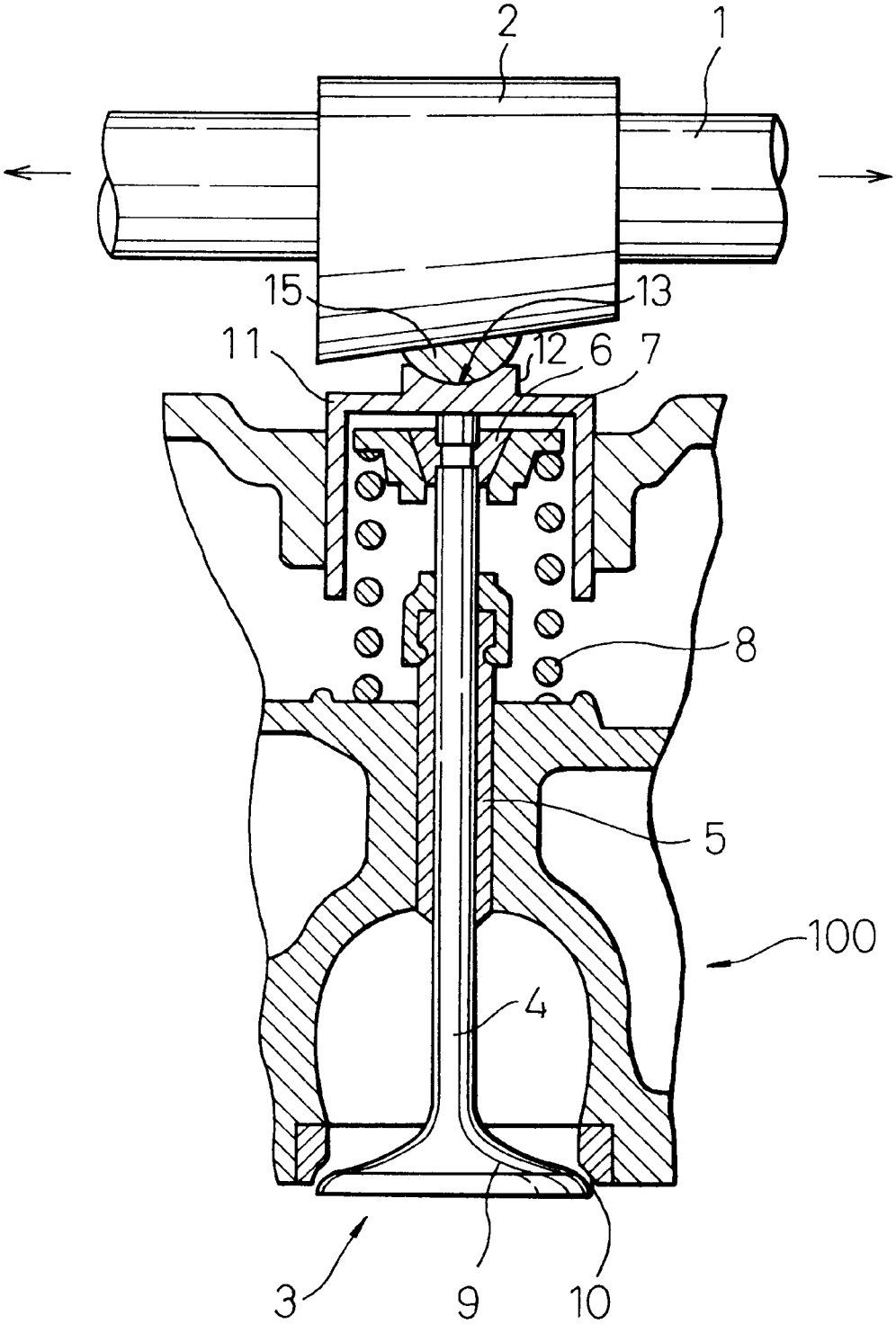
FIG. 2 is a side sectional view of an overall structure of the first embodiment.

FIG. 1 is an exploded view of a first embodiment of the present invention and FIG. 2 is a side sectional view of an assembly thereof.

With reference to FIG. 1, a cam 2 having a three-dimensional cam profile varying in the axial direction is integrated with a cam shaft 1. The cam shaft 1 is driven by a driving means not shown to displace in the axial direction in accordance with the operating conditions.

As shown in FIG. 2, a valve stem 4 of a poppet valve 3 is held by a cylinder head 100 via a valve guide 5. A spring retainer 7 is attached to an upper end of the valve stem 4 of the poppet valve 3 via a cotter pin 6. A lower surface of the spring retainer 7 is always applied with an upward bias by a valve spring 8, and, as a result, the poppet valve 3 is also applied with an upward bias, whereby an umbrella portion 9 of the poppet valve 3 is away from a valve seat 10, to form a flow path, only while the poppet valve 3 is pushed down by the cam 2. A valve lifter 11 is placed on a top surface of the valve stem 4 of the poppet valve 3 for receiving a pushing force of the cam 2.

With reference again to FIG. 1, on a top surface of the valve lifter 11 is formed a guide block 12 which in turn is provided with a guide groove 13 formed on a top surface thereof. Opposite ends of the guide block 12 project outward from the periphery of the valve lifter 11 as seen in the rotational direction of the cam 2, and the guide groove 13 extends over the length of the guide block 12. Since a follower 15 placed in the guide groove 13 tilts in a sliding manner as described later, it is necessary to machine a slide-contact surface of the guide groove with a high degree of precision. According to this embodiment, this high precision machining is easily achievable without any limitation because the guide groove 13 is provided throughout the length of the guide block 12.

Then, a pair of stoppers 14 prepared as separate parts are fixedly secured to opposite ends of the guide groove 13 by a proper method, such as a welding. The follower 15 prepared to fit with the guide groove 13 which is shortened by the stoppers 14 and has a cross-sectional shape slidably fitting to that of the guide groove 13 is placed on the guide block 12. Therefore, the follower 15 tilts as a flat top surface 15*a* thereof follows a profile of the cam 2, so that a force derived from the cam is received by the surface. Thus, a wear of the cam surface and the lifter is prevented.

Figure 3:
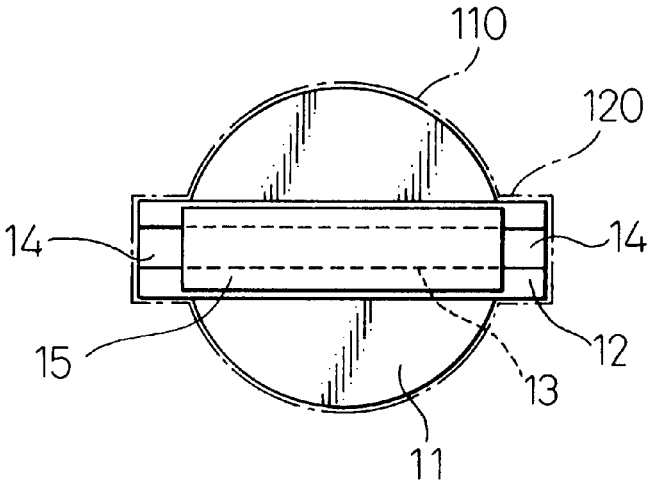
FIG. 3 is a top view of a valve lifter of the first embodiment.

FIG. 3 is an illustration of the valve lifter 11, thus assembled, viewed from above. A vertical hole 110 is shown by a chain line in FIG. 3, which is bored in the cylinder head 100 so that the valve lifter 11 is movable in parallel to the axis of the valve stem 4 of the poppet valve 3. As shown in FIG. 3, a pair of vertical grooves 120 having recessed cross-sections are formed in the cylinder head 100 so that projections 12*a* of the guide block 12 are movable. In such a manner, it is possible to prevent the valve lifter 11 from rotating.

Figure 4:
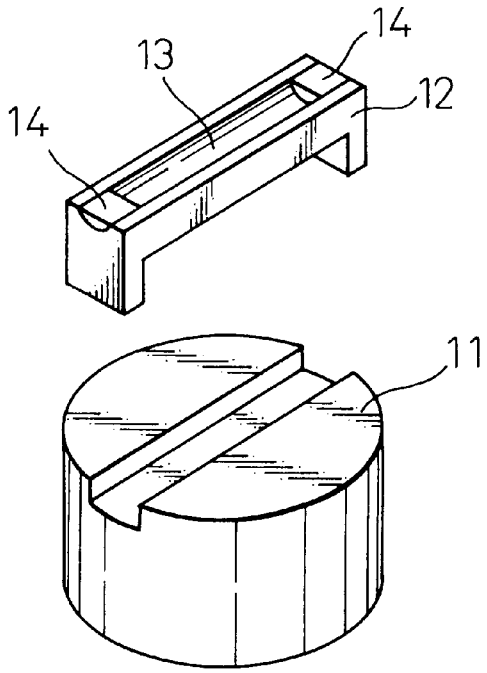
FIG. 4 is a perspective view of a guide block prepared as a separate part used for the first embodiment.

In this regard, it is also possible to not form a guide block 12 in integral with a valve lifter 11 but to prepare the guide block 12 separately from the valve lifter 11 as shown in FIG. 4 and fitting the both to each other.

Figure 5:
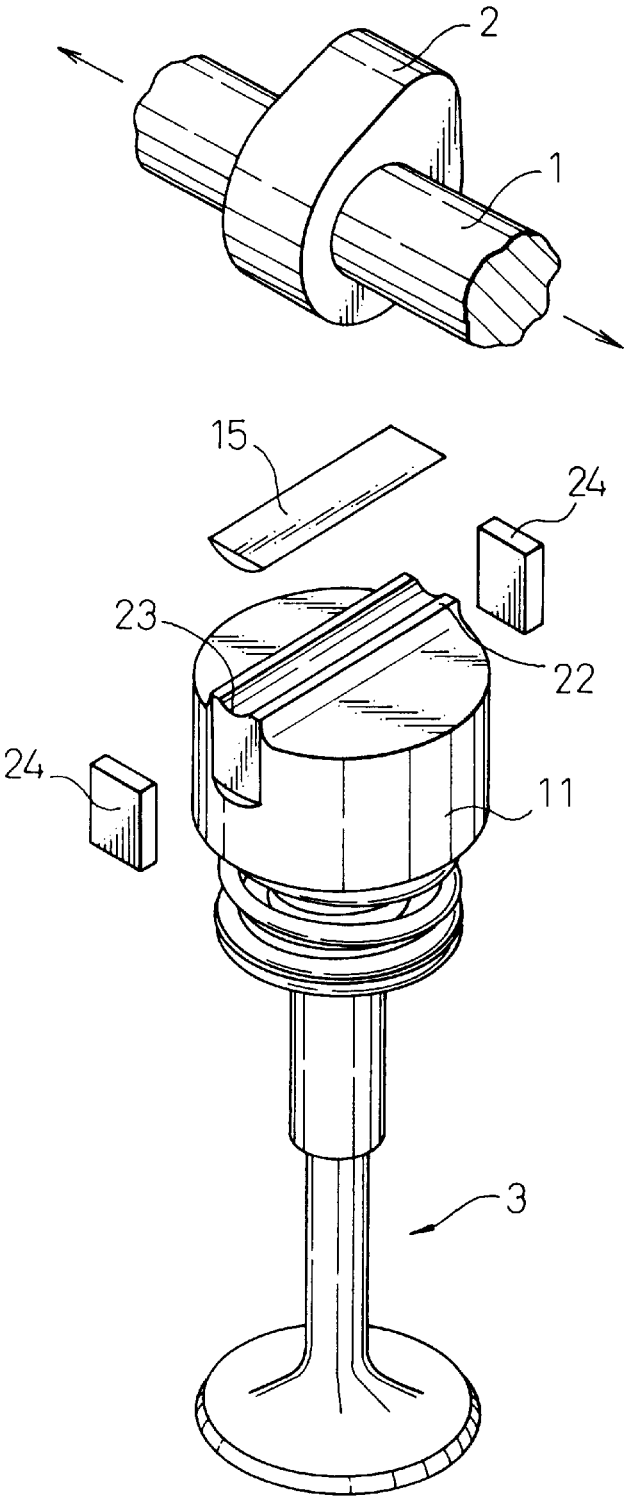
FIG. 5 is an exploded perspective view of a second embodiment of the present invention.

FIG. 5 is an exploded perspective view of a second embodiment of the present invention wherein a guide block 22 is not formed to project outside from the outer periphery of a valve lifter 11, and a pair of stoppers 24 is not attached to the interior of a guide groove 23 but is attached to the lateral surfaces thereof.

This structure is advantageous in that the machining of the guide block is facilitated when it is formed integrally with the valve lifter.

Figure 6:
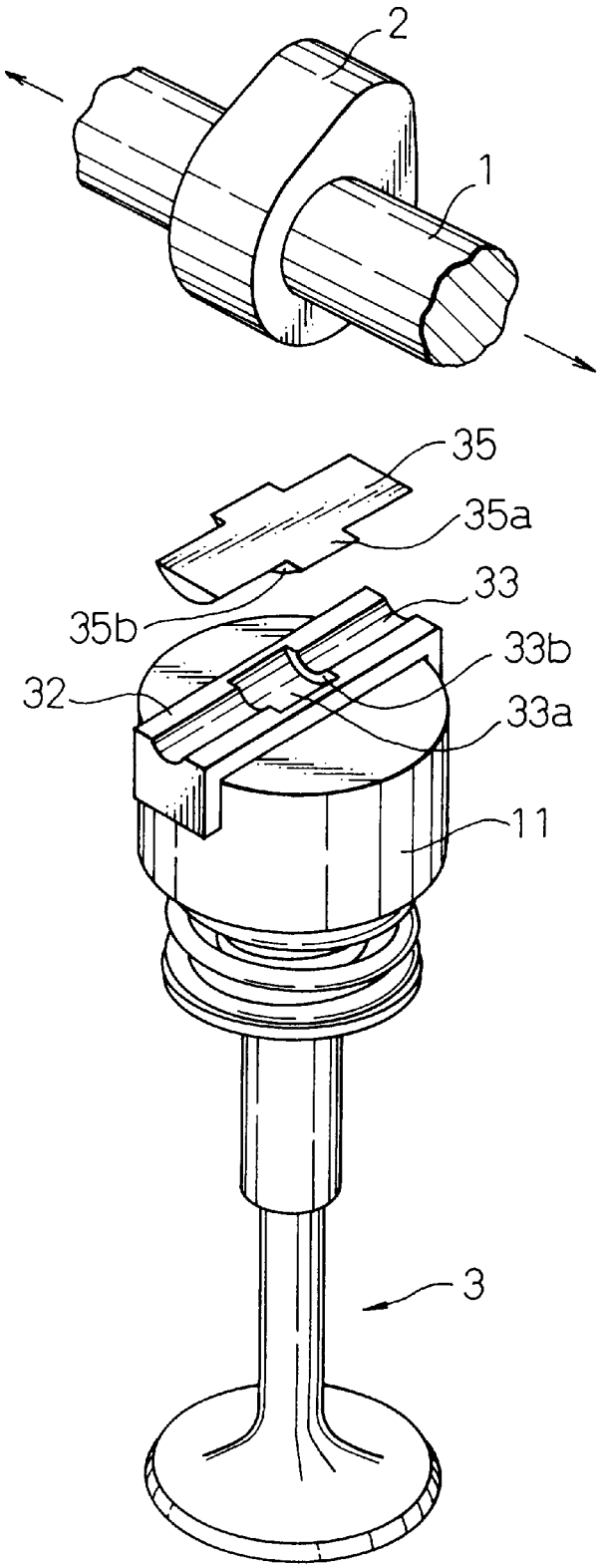
FIG. 6 is an exploded perspective view of a third embodiment of the present invention.

FIG. 6 is an exploded perspective view of a third embodiment of the present invention. According to the third embodiment, a guide groove 33 has an enlarged groove section 33*a* in a central area thereof, and a follower 35 similarly has an enlarged follower section 35*a* in a central area thereof, so that lateral surfaces of the enlarged groove section 33*a* and those of the enlarged follower section 35*a* of the follower 35 abut to each other to inhibit the follower 35 from being displaced in the rotating direction of the cam 2. In this regard, opposite ends of a guide block 32 project outside from the outer periphery of a valve lifter 11 in a similar manner as in the first embodiment for the purpose of preventing the valve lifter 11 itself from rotating.

This structure is advantageous in that the number of parts is minimized because it is unnecessary to prepare separate members as stoppers, and the mechanical strength of the follower increases because the thickness of the enlarged follower section 35 of the follower 35 becomes larger.

According to the present invention, a valve lifter for a three-dimensional cam, of a type wherein a follower tilts in a guide groove, is provided which is easily machined without weakening the follower.

What we claim is:

1. A valve lifter apparatus for varying the characteristics of a poppet valve by axially displacing a three-dimensional cam having a cam profile that varies in an axial direction, comprising:

a valve lifter having a block groove extending along a diametrical axis of the valve lifter, the valve lifter being interposed between the cam and an upper end of a valve stem of the poppet valve;

a guide block that is separate from the valve lifter and is placed in the block groove of the valve lifter such that the guide block protrudes upward from a top surface of the valve lifter and the guide block extends beyond the valve lifter in a direction coaxial to the diametrical axis of the valve lifter to form an anti-rotation member for preventing the valve lifter from rotating;

a guide groove that is formed in the guide block, the guide groove having a longitudinal axis and extends coaxial to and entirely along the diametrical axis of the valve lifter that is perpendicular to the axial direction of the cam profile, the guide groove having a first open end and a second open end;

a follower extending in parallel to the guide groove, the follower tilting in accordance with a change of the cam profile while being brought into slide-contact with the guide groove; and limiting means for limiting displacement of the follower along the longitudinal axis of the guide groove, the limiting means comprising stoppers and abutment members, the stoppers being associated with the guide groove and the abutment members being located on the follower.

2. The valve lifter apparatus according to claim 1, wherein the stoppers comprise a first stopper and a second stopper formed separately from the guide groove and the first stopper is positioned in a first end portion of the guide groove and the second stopper is positioned in a second end portion of the guide groove and the abutment members comprise a first end wall of the follower and a second end wall of the follower, the first end wall engaging the first stopper and the second end wall engaging the second stopper, thereby limiting displacement of the follower along the longitudinal axis of the guide groove.

3. The valve lifter apparatus according to claim 1, wherein the stoppers comprise a first stopper attached to the first open end of the guide groove and a second stopper attached to the second open end of the guide groove such that the first stopper closes the first open end of the guide groove and the second stopper closes the second open end of the guide groove and the abutment members comprise a first end wall of the follower and a second end wall of the follower, the first end wall engaging the first stopper and the second end wall engaging the second stopper, thereby limiting displacement of the follower along the longitudinal axis of the guide groove.

* * * * *